US006413195B1

(12) United States Patent
Barzelay

(10) Patent No.: US 6,413,195 B1
(45) Date of Patent: Jul. 2, 2002

(54) PASSIVE/ACTIVE FLUID EXERCISE DEVICE

(76) Inventor: Abraham Barzelay, c/o Advanced Data System Corp., 255 Spring Valley Ave., Maywood, NJ (US) 07607

( * ) Notice: Subject to any disclaimer, the term of this patent is extended or adjusted under 35 U.S.C. 154(b) by 0 days.

(21) Appl. No.: 09/828,855

(22) Filed: Apr. 10, 2001

Related U.S. Application Data

(60) Provisional application No. 60/196,923, filed on Apr. 13, 2000.

(51) Int. Cl.[7] ..... A63B 21/005

(52) U.S. Cl. ..... 482/112; 482/5; 482/900

(58) Field of Search ..... 482/1–9, 51, 57, 482/900–902, 903; 318/9, 10; 600/587, 595; 601/23

(56) References Cited

U.S. PATENT DOCUMENTS 5,314,390 A * 5/1994 Westing et al. ..... 482/6
5,583,403 A * 12/1996 Anjanappa ..... 318/9
5,830,160 A * 11/1998 Reinkensmeyer ..... 600/595

* cited by examiner

*Primary Examiner*—Glenn E. Richman
(74) *Attorney, Agent, or Firm*—Roger H. Flagg

(57) ABSTRACT

A passive/active hydraulic exercise device having a base portion, an upright support and a pivot bard is selectively placed in either a passive push and pull type resistance mode or an active velocity type mode. In the passive mode, a pump can be off or on during "idling". A solenoid valve is energized to an open position, and a servo valve sets a resistance for the fluid flow in the system. A check valve compensates for the differential areas of the cylinder. The active mode is useful for physical therapy applications. In this mode, a constant cycling operation is provided at absolute minimum force levels. The load cell senses the actual force generated, and the position feedback senses actual movement of the exercise bar. As long as the subject is providing enough force to move the bar, the feedback device confirms movement to the computer which adjusts the resistance of the electronic pressure control valve to a value which will allow the subject to continue moving the bar. This force is measured by the load cell and controlled by the servo-valve.

20 Claims, 6 Drawing Sheets

201
Electronic Interface
200
Main Computer
202
Network Interface
Load Cell (5)
Servomotor (2)
Servomotor (11)
Feedback Device (8)
Solenoid Valve (10)
Pressure Transducer (9)
Heartbeat Monitor (15)
Feedback Device (8)

PASSIVE/ACTIVE FLUID EXERCISE DEVICE

This application claims benefit of Provisional No. 60/196,923 filed Apr. 13, 2000.

FIELD OF THE INVENTION

The present invention relates to a passive/active fluid exercise device. More particularly, the invention relates to a passive/active fluid exercise device which includes computerized control of fluid flow through a fluid system, and includes force (resistance) and movement sensors.

BACKGROUND OF THE INVENTION

For purposes of this disclose, the term fluid is intended to include hydraulic fluid as well as pneumatic fluid.

Exercise devices of the type having a variety of controls, sensors, and hydraulic or pneumatic arrangements, are known in the prior art.

U.S. Pat. No. 4,722,525 to Brentham discloses a physical fitness testing apparatus which includes a hydraulic exercise device. The apparatus includes transducers for determining force applied by the user and selector valves connected to double acting cylinders to provide resistance in opposite directions.

U.S. Pat. No. 5,230,672 to Brown et al. discloses a computerized exercise apparatus which includes a load cell. The load cell is used in conjunction with hydraulic pistons to control tension and provide feedback to the user of the equipment.

U.S. Pat. No. 5,314,390 discloses a programmable exerciser wherein a motor is provided. The motor is used to perform iso-acceleration and iso-deceleration exercises, and has a limb move mode for assisting users.

U.S. Pat. No. 5,011,142 to Eckler teaches an exercise control system which includes a closed hydraulic circuit. The closed hydraulic circuit is used to provide positive and negative iso-dynamic resistance, and a combination of rotary and linear cylinders is used to control torque ratios.

U.S. Pat. No. 5,356,353 to Takaoka relates to exercise devices having monitoring and control of the range of motion.

U.S. Pat. No. 5,209,715 to Walker et al. teaches an automatic force generating and control system, for use in exercise equipment.

U.S. Pat. No. 4,919,418 to Miller teaches exercise equipment having a computerized drive mechanism for exercise, physical therapy, and rehabilitation.

U.S. Pat. No. 4,846,466 to Stima teaches microprocessor controlled exercise equipment having an electro-hydraulic exercise system.

U.S. Pat. No. 4,544,154 to Ariel teaches exercise equipment which includes a passive programmable resistance device.

SUMMARY OF THE INVENTION

From the foregoing, it is seen that it is a problem in the art to provide a device meeting the above requirements. According to the present invention, a device is provided which meets the aforementioned requirements and needs in the prior art. Specifically, the device according to the present invention provides a passive/active fluid exercise device which can be selectively placed in either a passive mode or an active mode, and wherein in the passive mode the system can provide a resistance type of operation, and an active mode can provide a velocity type of operation.

The different modes of operation are fully controlled by the computer software, for example. The passive system includes a push and pull mode. In this mode, a pump can be off or on during idling. Also in this mode, a solenoid valve is energized to an "open" position. A servo valve sets a resistance, or restriction, for the fluid flow in the system. As an exercise bar is pulled down, fluid is forced out of a rod end of a fluid cylinder, and at the same time, fluid is drawn into a cap end of the cylinder.

The actual resistance in the system is generated and controlled by the servo valve. In order to provide a true measure of the resistance, fluid entering the cap end of the cylinder is allowed access through a low pressure check valve which keeps any residual back pressure, or vacuum, to an absolute minimum. This check valve also compensates for the differential areas of the cylinder, simplifying the hardware arrangement.

The active mode is useful for physical therapy applications. In this mode of operation, the system is pre-configured to provide a constant cycling operation at absolute minimum force levels. This is accomplished in two ways. First, the load cell senses the actual force generated by the subject. Second, the position feedback senses actual movement of the exercise bar. As long as the subject is providing enough force to move the exercise bar, the feedback device confirms movement to the computer which will adjust the resistance which is set by the electronic pressure control valve, to a value which will allow the subject to continue moving the exercise bar. This force is measured by the load cell and controlled by the servo-valve.

Other objects and advantages of the present invention will be more readily apparent from the following detailed description when read in conjunction with the accompanying drawings.

DETAILED DESCRIPTION OF THE INVENTION

Figure 1:
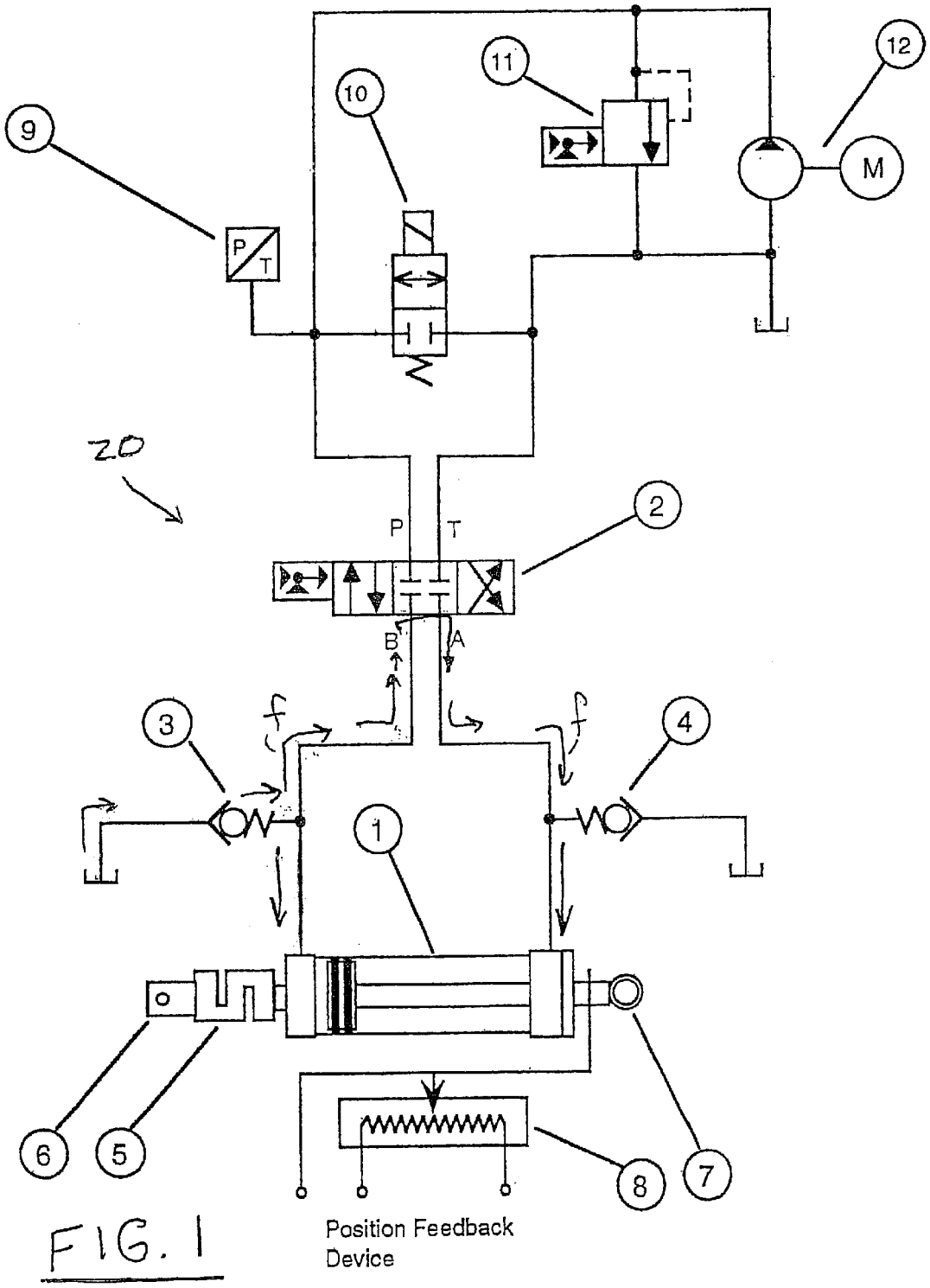
FIG. 1 is a schematic view of a fluid circuit of a passive system mode in a push arrangement, according to the present invention.

A passive/active exercise apparatus 100 is selectively placed in a resistance type passive operating mode or in an active type velocity operating mode, within a closed fluid circuit 20. A base member 3 is used for supporting the exercise apparatus 100 upon the floor. An upright member 1 is secured to said base member 3. A exercise bar 22 has a first arm 23 and a second arm 24 spaced apart at a handle end 25 and joined together at the cylinder end 26, said exercise bar 22 pivotally secured to said upright member 28 between the handle end 25 and the cylinder end 26, said first and second arms 23, 24 having handle portions 27 extending outwardly therefrom. At least one fluid cylinder 1 is connected between the upright member 28 and the cylinder end 26 of said exercise bar 22.

The device of FIG. 1 includes a passive mode of operation in a push-pull arrangement, and an active mode of operation in a velocity mode of operation.

As shown in FIG. 1, a fluid cylinder 1, such as a hydraulic cylinder or a pneumatic cylinder, is provided. At one end of the fluid cylinder 1 is a load cell 5 and a pivot mount 6. At the other end of the fluid cylinder 1 is a rod eye 7. Fluid enters opposite ends of the fluid cylinder 1, and flow thereto is controlled by check valves 3 and 4. A servo control valve 2 routes flow in four flow arrangements, as depicted in the drawing FIG. 1 through FIG. 4.

At an upper portion of the fluid circuit of FIG. 1, a motor M having a pressure controller 12 is provided. Also provided is a pressure transducer 9 as well as solenoid valves 10 and 11.

A position feedback device 8 is provided to determine the position of the cylinder 1, and provides this information to the computer 200.

Passive System:

In the passive mode shown in FIG. 1, which is in a push arrangement, the system can provide a resistance type operation, a velocity type operation or a combination of both. In the passive system mode, using a push arrangement of FIG. 1, the flow is routed in the manner shown by the arrows f. In FIG. 1, the entire upper portion of the fluid circuit 20 is cut off from the fluid flow.

The various different modes of operation are preferably fully controlled by a computer 200 (shown in FIG. 7) which would run software specifically designed for this system. One having ordinary skill in the computer programming arts would be able to provide such a program based on the information contained herein.

Figure 2:
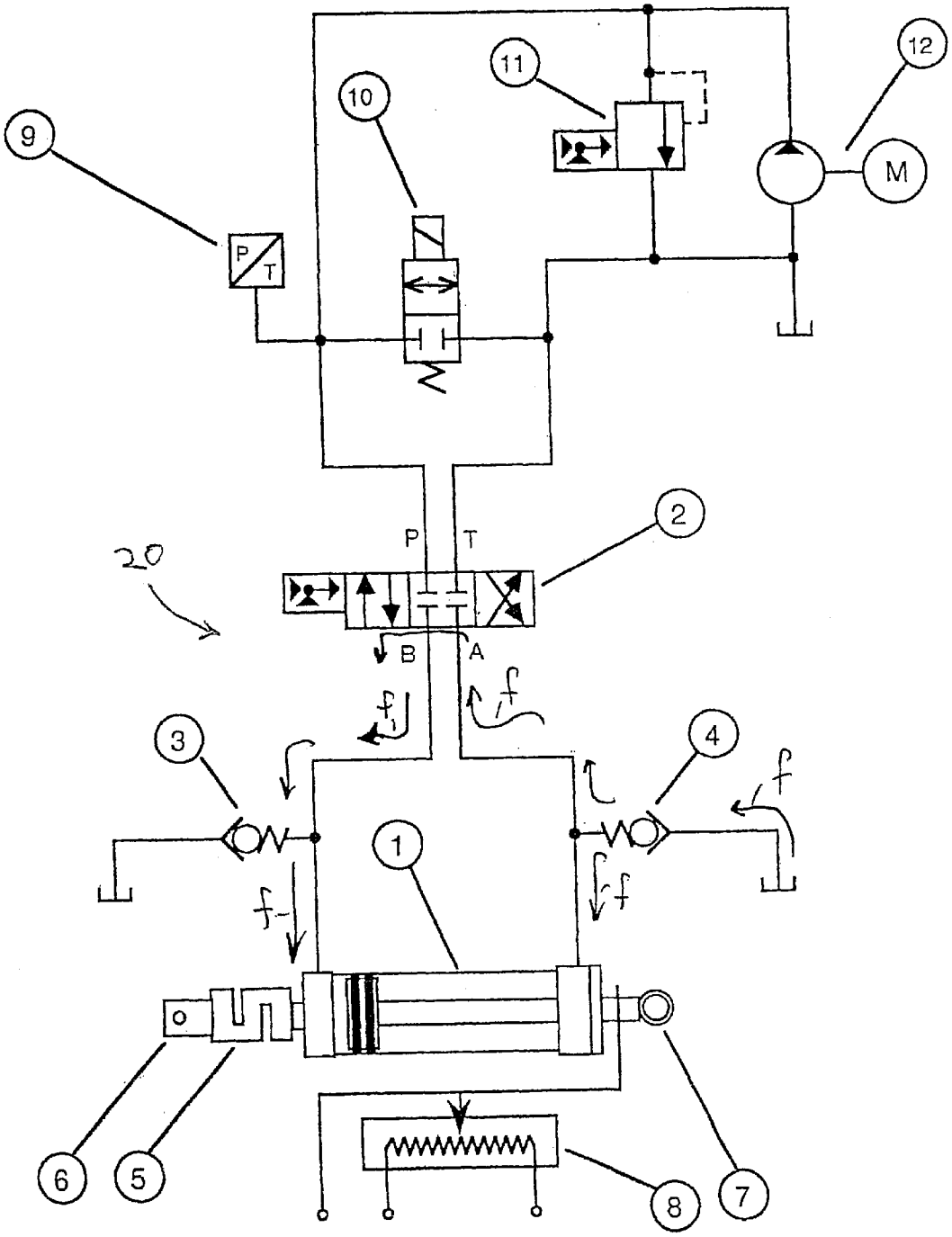
FIG. 2 is a schematic view of a fluid circuit of a passive system mode in a pull arrangement.

The passive system of FIGS. 1 and 2 respectively include the push and pull modes of operation mentioned above. In the passive mode, the pump M, having a pressure controller 12 can be off or on during idling. Also in this mode, the solenoid valve 10 is energized to an open position.

The passive system mode in a pull arrangement of FIG. 2 has the identical parts as described in FIG. 1, but the fluid flow is routed in a different manner as shown by the arrows f in FIG. 2. Like FIG. 1, the entire upper portion of the fluid circuit 20 is cut off from the fluid c flow. As seen in FIG. 2, a portion of the fluid flow is reversed as compared with that of FIG. 1.

The following is a description of the fluid flow in the arrangement for the passive modes of FIGS. 1 and 2. The servo control valve 2 sets a resistance, or restriction, for the fluid flow in the fluid circuit 20. As the exercise bar 22 (FIG. 5) of the exercise apparatus 100 is pulled down, fluid is forced out of the rod end 30 of the fluid cylinder 1. At the same time, fluid is drawn into the cap end 32 of the cylinder 1.

The actual resistance in the fluid circuit 20 is generated and controlled by the servo control valve 2. In order to provide a true measure of the resistance, the fluid entering the cap end 30 of the cylinder 1 is allowed access through a low pressure check valve 3 or 4 which keeps any residual back pressure, or vacuum, to an absolute minimum.

This check valve 3 or 4 also compensates for the differential areas of the fluid cylinder 1, simplifying the hardware arrangement.

After the fluid is forced through the servo control valve 2 from the rod end 30 of the cylinder 1, it is connected back into the opposite end of the fluid cylinder 1 through the solenoid valve 10 or 11 and then to the other port of the servo control valve 2, completing the fluid circuit 20.

As the handle portion 27 of the exercise bar 22 is pushed up, fluid is forced out of the cap end 32 of the fluid cylinder 1. At the same time, fluid is drawn into the rod end 30 of the cylinder 1 through a check valve 3 at that end, to compensate for the differential areas of the fluid cylinder 1.

The actual resistance in the fluid circuit 20 is generated and controlled by the servo control valve 2. In order to provide a true measure of the resistance, fluid entering the rod end 30 of the cylinder 1 is allowed access through a low pressure check valve 3 which keeps any residual back pressure to an absolute minimum.

After the fluid is forced through the servo control valve 2 from the cap end 32 of the fluid cylinder 1, it is connected back into the rod end 30 of the fluid cylinder 1 through the solenoid valve 10 and then to the other port of the servo control valve 2, completing the fluid circuit 20.

Active Mode

Figure 3:
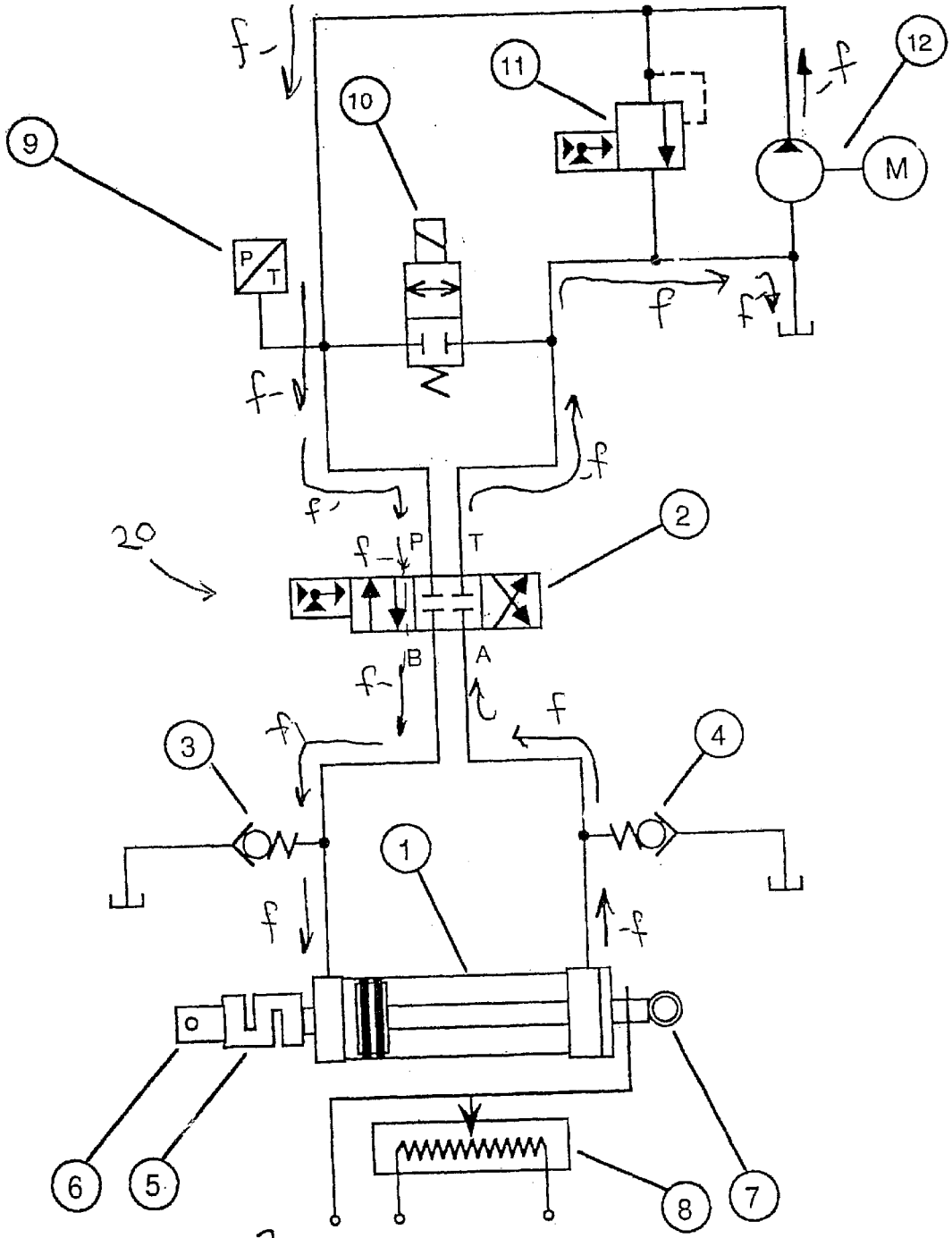
FIG. 3 is a schematic view of a fluid circuit of an active system mode in a push arrangement.
Figure 4:
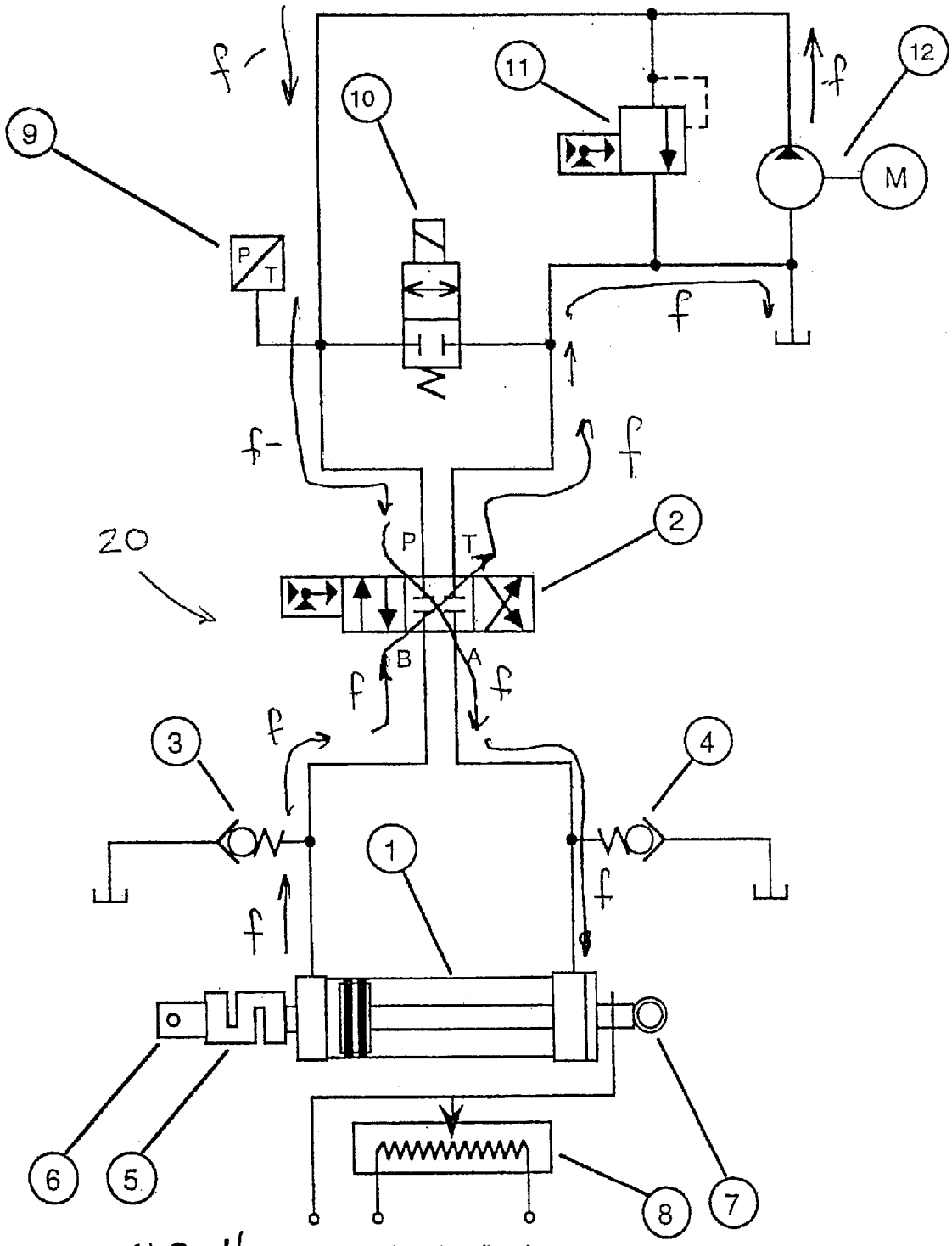
FIG. 4 is a schematic view of a fluid circuit of an active system mode in a pull arrangement.

FIG. 3 is a schematic view of a fluid circuit 20 of an active system mode in a push arrangement, and FIG. 4 is a schematic view of a fluid circuit 20 of an active system mode in a pull arrangement. The parts shown and the numbers thereof are the same as those of FIGS. 1 and 2 described herein.

The active mode is useful for physical therapy applications. In this mode of operation, the system is pre-configured to provide a constant cycling operation at absolute minimum force levels.

The active system push-pull mode is the most dynamic mode of operation for the system. The computer 200 and its associated feedback device(s) 8, and transducers (5, 9) are used in concert to provide the ultimate resistance/assistance operation of the equipment. The description of this operation is as follows.

The operator begins by pushing up on the exercise bar. As the operator does this, the computer 200 senses his or her ability to move the bar 22. This is accomplished in two ways: first, the load cell 5 senses the actual force, generated by the user. And second, the position feedback device 8 senses actual movement of the exercise bar 22.

As long as the user is providing enough force to move the exercise bar 22, the feedback device 8 confirms movement to the computer 200 which will adjust the resistance which is set by the electronic pressure control valve 2, to a value which will allow the user to continue moving the exercise bar 22. This force is measured by the load cell and controlled by the servo control valve 2.

At the same time, the speed at which the user is moving the exercise bar 22 is sensed by the feedback device 8. The computer 200 will adjust the flow of the servo control valve 2 to allow the user to operate at his or her level of ability.

The dynamic exercise apparatus 100 will allow the subject to either speed up or slow down while maintaining the desired resistance under any changing condition.

In the event that movement stops (which would signify an inability of the user to overcome the resistance in the system) the feedback device 8 again confirms to the computer 200 that movement has stopped. At this point, the active mode takes over and provides assistance by adjusting flow (at the servo control valve 2) and pressure (at the pressure controller 11), to the appropriate end of the fluid cylinder 1, thereby "assisting" the subject to move the bar. This pressure adjustment is sensed by a pressure transducer 9 and fed back to the computer 200 to allow for continual monitoring and adjustment of pressure to maintain the optimum levels.

The computer 200 continually "scans" information from the load cell 5 and the feedback device 8 and will, at any time, adjust the resistance or speed, to match the capability of the user operating the equipment.

By operating in this "active" mode in both directions, the user is never overstrained by the system, and in fact, is encouraged to continue and progress.

Additionally, the system is pre-configured to provide a constant cycling operation at absolute minimum force levels. The user grasps the exercise bar 22, or in severe cases the hands are fixed to the exercise bar 22, and the exercise apparatus moves the exercise bar 22 up and down rhythmically, providing a therapeutic movement. This is particularly useful in rehabilitation when the user, due to muscle loss or injury, is incapable of providing even the least amount of force for themselves.

During this mode of operation, the exercise apparatus 100 continually monitors all movements and load forces on the exercise bar 22. This is important since any deviation from the normal rhythmic movement could signal distress on the part of the user. Should this occur, the system will immediately stop all movement and provide audible or visual alerts, avoiding any possible injury to the user.

Figure 5:
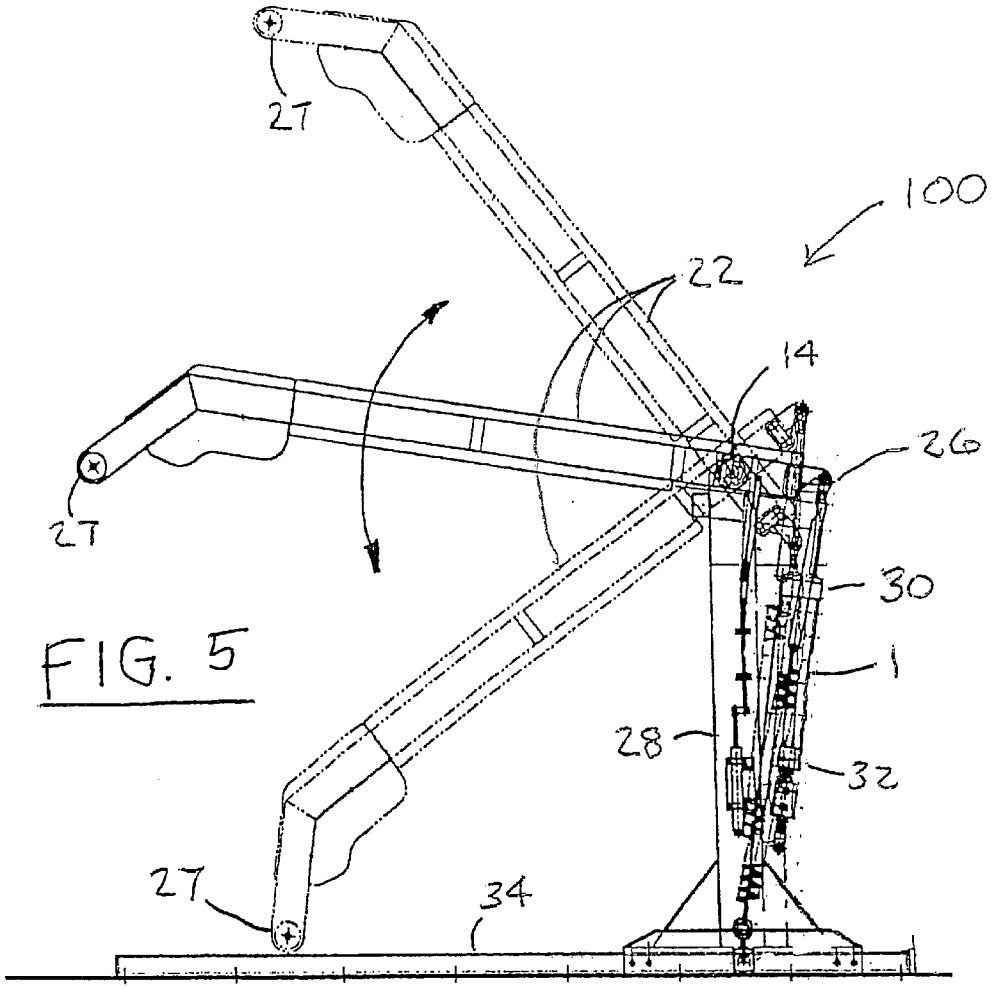
FIG. 5 is a side elevational view of the exercise apparatus according to the present invention.

FIG. 5 is a side elevational view of an exercise apparatus 100 according to the present invention, showing a midrange position in solid line, and upper and lower positions in dashed line.

Figure 6:
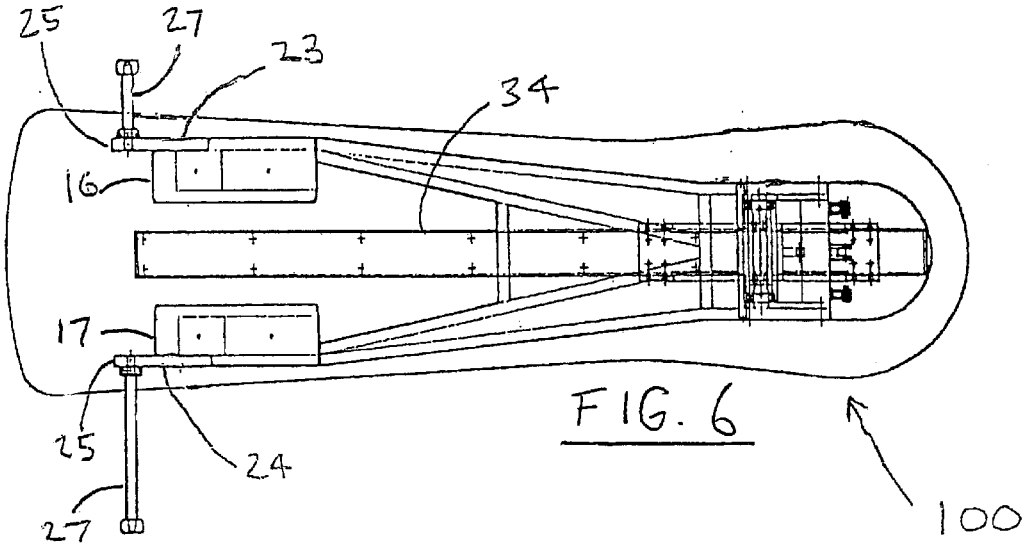
FIG. 6 is a breakaway side elevational view of the exercise apparatus shown in FIG. 5.

FIG. 6 is a breakaway side elevational view of the exercise apparatus 100 of FIG. 5, showing the component parts of the exercise apparatus 100 separated from the frame member 34.

Figure 7:
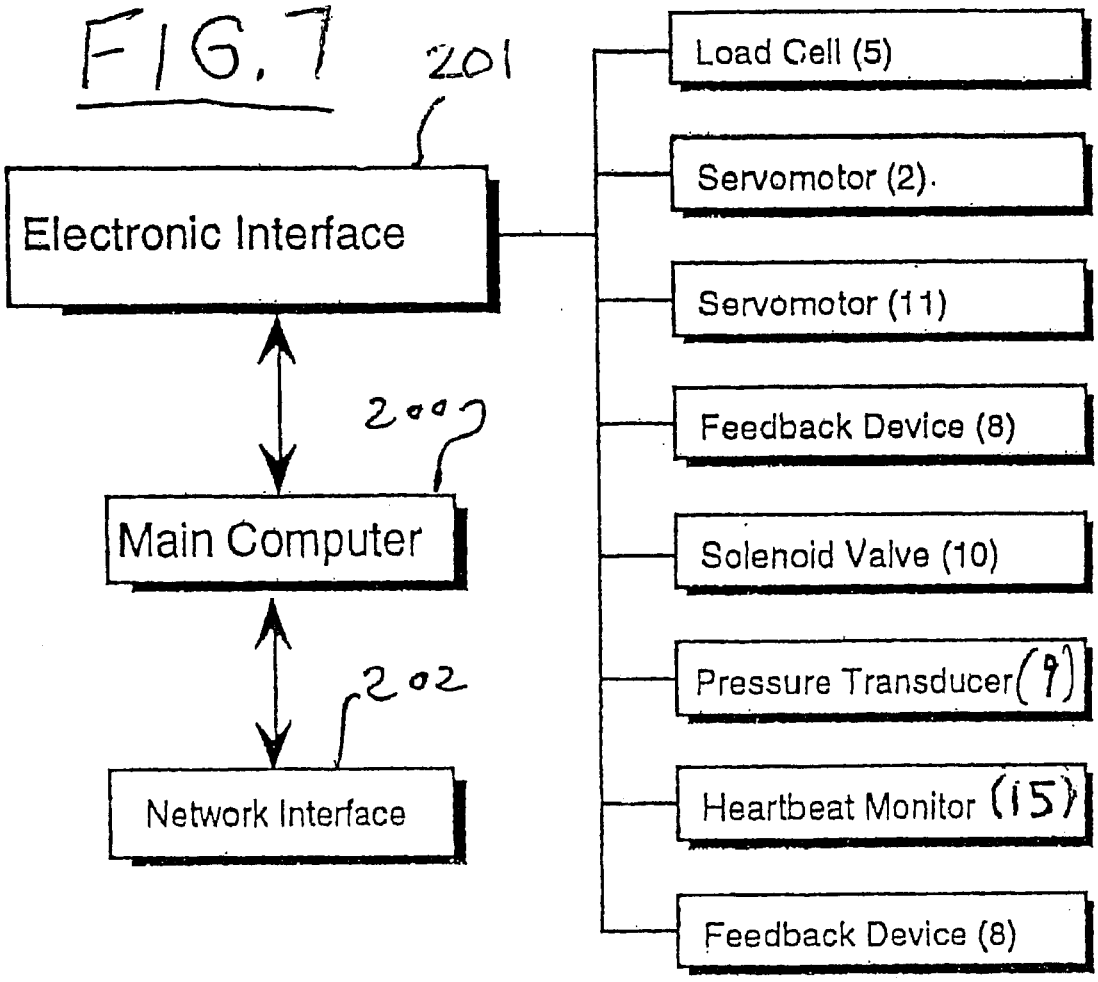
FIG. 7 is a schematic view of a computer control arrangement for the fluid circuit according to the present invention.

FIG. 7 is a schematic view of a computer control arrangement for the fluid circuit 20 according to the present invention. In this view, the computer 200 interfaces with a network interface 202 and with an electronic interface 201. The electronic interface 201 communicates with the load cell 5, the servomotor 2, the servomotor 11, the feedback device 8, the solenoid valve 10, the pressure transducer 9, and (optionally) with a heartbeat monitor 15.

The exercise apparatus 100 hardware and software provides the capabilities of local networking, as well as remote modem connection. This allows for real-time monitoring of progress, downloading of personalized settings, the compiling of information about progress, changes, effects, etc.

In addition to the capabilities described above, the exercise apparatus 100 has a first leg apparatus 16 operatively connected to the first arm 23, and a second leg apparatus 17 operatively connected to the second arm 24 for use on leg training and upper limb conditioning. All previously described functions are incorporated in this adaptation as well, in accordance with the disclosure provided.

It is within the scope of this disclosure to selectively move the first and second arms 23, 24 together, or to move the first and second arms 23, 24 in opposite directions. Likewise, the first and second leg apparatus 16, 17 may be adapted to move together, or to move in opposite directions.

The invention being thus described, it will be evident that the same may be varied in many ways. Such variations are not to be regarded as a departure from the spirit and scope of the invention and all such modifications are intended to be included within the scope of the claims.

What is claimed is:

1. An exercise apparatus which is selectively placed in a resistance type passive operating mode and in an active type velocity operating mode, within a closed fluid circuit, which comprises:

a) a base member for supporting the exercise apparatus;

b) an upright member secured to said base member;

c) a pivot bar having a first arm and a second arm spaced apart at a handle end and joined together at a cylinder end, said pivot bar pivotally secured to said upright member between the handle end and the cylinder end, said first and second arms having handle portions extending outwardly therefrom;

d) at least one fluid cylinder connected between the upright member and the first end of said arm;

e) a fluid pumping means in operable connection with the fluid cylinder;

f) at least one force resistance sensor for monitoring the force generated by movement of said arm;

g) at least one velocity sensor for monitoring the velocity of the fluid within the fluid circuit;

g) at least one solenoid valve to selectively actuate the fluid pumping means;

h) at least one servo valve to set the minimum resistance of the fluid within the fluid circuit;

i) at least one load cell to sense the actual force generated by movement of the exercise bar;

j) at least one check valve to keep any residual back pressure within the fluid circuit to a minimum in the passive operating mode;

k) a computer control system with software to selectively control movement of the fluid within the fluid circuit;

l) the active mode provides a constant cycling of the fluid within the fluid circuit at minimum force levels responsive to movement of the exercise bar, which is useful for physical therapy applications, and m) the passive mode provides a resistance relating to the push and pull of the exercise bar, and the solenoid valve is energized to an open position where the fluid forced out of a rod end of said cylinder is routed through a low pressure check valve to keep any residual pressure to a minimum, then redirected into a cap end of said cylinder.

2. The exercise apparatus of claim 1, wherein a combination of rotary and linear cylinders are used to control the torque ratios generated within the fluid system.

3. The exercise apparatus of claim 1, wherein the fluid circuit is a hydraulic fluid circuit.

4. The exercise apparatus of claim 1, wherein a motor having a pressure controller is used to control the fluid pressure within the closed fluid circuit.

5. The exercise apparatus of claim 1, wherein a position feed back device is provided to monitor the position of the fluid cylinder, and to transmit the position of the fluid cylinder to the computer control system.

6. The exercise apparatus of claim 1, wherein the speed at which the exercise bar is moved is monitored by a load cell, and the resistance is adjusted to match the capability of the user operating the exercise apparatus.

7. The exercise apparatus of claim 1, wherein all movements and load forces on the exercise bar are monitored, and the system is immediately shut down when a deviation from the normal rhythmic movement is sensed, and at least one of an audible alarm and a visual alert is actuated to avoid any possible injury to the user.

8. The exercise apparatus of claim 1, wherein the computer interfaces with a network interface and with an electronic interface for real-time monitoring of progress, downloading of personalized settings, and the compiling of information about progress, changes, and effects.

9. The exercise apparatus of claim 1, wherein a first leg apparatus is operatively connected to the first arm of the exercise bar, and a second leg apparatus is operatively connected to the second arm of the exercise bar, and the first and second leg apparatuses are adapted for use with the exercise apparatus for leg training and upper limb conditioning.

10. An exercise apparatus which is selectively placed in one of a resistance type passive operating mode and in an active type velocity operating mode, within a closed fluid circuit, which comprises:

a) a base member for supporting the exercise apparatus thereon;

b) an upright member secured to said base member;

c) a exercise bar having a first arm and a second arm spaced apart at a handle end and joined together at a cylinder end, said exercise bar pivotally secured to said upright member between the handle end and the cylinder end, said first and second arms having handle portions extending outwardly therefrom;

d) at least one rotary cylinder and at least one linear cylinder are secured to the upright member at a first end, and to the cylinder end of the pivot bar at the opposite end, said cylinders used to control the torque ratios generated within the fluid circuit;

e) a fluid pumping means in operable connection with the fluid cylinders;

f) at least one force resistance sensor for monitoring the force generated by movement of said exercise bar;

g) a motor connected to a pressure controller to control the fluid pressure within the closed fluid circuit;

h) at least one velocity sensor for monitoring the velocity of the fluid within the fluid circuit;

i) at least one solenoid valve to selectively actuate the fluid pumping means;

j) at least one servo valve to set the resistance of the fluid within the fluid circuit;

k) at least one low pressure check valve to keep any residual back pressure within the fluid system to a minimum in the passive operating mode; and l) a computer control system with software to control the movement of the fluid within the fluid circuit; and the active mode provides a constant cycling of the fluid within the fluid circuit at minimum force levels responsive to movement of the exercise bar, which is useful for physical therapy applications; and the passive mode provides a resistance relating to the push and pull of the exercise bar, and the solenoid valve is energized to an open position where the fluid is forced out of a rod end of said cylinder, and said fluid is redirected into a cap end of said cylinder.

11. The exercise apparatus of claim 10, wherein the minimum force level is controlled by a servo valve, as a load cell senses the actual force generated by movement of the exercise bar to adjust the resistance measured by the load cell.

12. The exercise apparatus of claim 10, wherein fluid entering the cap end of the cylinder is allowed access through a low pressure check valve to keep any residual back pressure to a minimum.

13. The exercise apparatus of claim 10, wherein a position feedback device is provided to determine the position of the cylinder, and to transmit the position of the cylinder to the computer control system.

14. The exercise apparatus of claim 10, wherein the speed at which the exercise bar is moved is monitored by a load cell, and the resistance is adjusted to match the capability of the user operating the equipment.

15. The exercise apparatus of claim 10, wherein all movements and load forces on the exercise bar are monitored, and the exercise apparatus is immediately shut down when a deviation from the normal rhythmic movement is sensed, and at least one of an audible and a visual alert is actuated to avoid any possible injury to the user.

16. The exercise apparatus of claim 10, wherein the computer interfaces with a network interface and with an electronic interface for real-time monitoring of progress, downloading of personalized settings, and the compiling of information about at least one of: progress, changes and effects.

17. The exercise apparatus of claim 10, wherein a first leg apparatus is operatively connected to the first arm of the pivot bar, and a second leg apparatus is operatively connected to the second arm of the pivot bar, and the first a and second leg apparatuses are adapted for use with the exercise apparatus for leg training and upper limb conditioning.

18. An exercise apparatus which is selectively placed in one of a resistance type passive operating mode and in an active type velocity operating mode, within a closed fluid circuit, which comprises:

a) a base member for supporting the exercise apparatus;

b) an upright member secured to said base member;

c) an exercise bar having a first arm and a second arm spaced apart at a handle end and joined together at a cylinder end, said exercise bar pivotally secured to said upright member between the handle end and the cylinder end, said first and second arms having handle portions extending outwardly therefrom;

d) at least one rotary cylinder and at least one linear cylinder are secured to the upright member at a first end, and to the cylinder end of the pivot bar at the opposite end, said cylinders used to control the torque ratios generated within the fluid circuit;

e) a fluid pumping means operable in connection with the fluid cylinders;

f) at least one force resistance sensor for monitoring the force generated by movement of said arm;

g) a motor connected to a pressure controller to control the fluid pressure within the closed fluid circuit;

h) at least one velocity sensor for monitoring the velocity of the fluid within the fluid circuit;

i) at least one solenoid valve to selectively actuate the fluid pumping means;

j) at least one servo valve to set the resistance of the fluid within the fluid circuit;

k) at least one load cell to monitor the speed at which the exercise bar is moved, and the resistance is adjusted to match the capability of a user operating the exercise apparatus;

l) at least one low pressure check valve to keep any residual back pressure within the fluid circuit to a minimum in the passive operating mode;

m) at least one position feedback device is provided to determine the position of the fluid cylinder, and to transmit the cylinder position to the computer control system;

n) a computer control system with software to control movement of the fluid within the fluid circuit; the computer interfaces with a network interface and an electronic interface for real-time monitoring of the user's progress, the downloading of personalized setting, the compiling of information about at least one of: progress, changes and effects; and the active mode provides a constant cycling of the fluid within the fluid circuit at minimum force levels responsive to movement of the exercise bar, which is useful for physical therapy applications; and the passive mode provides a resistance relating to the push and pull of the exercise bar, and the solenoid valve is energized to an open position where the fluid forced out of a rod end of said cylinder, and is redirected into a cap end of said cylinder.

19. The exercise apparatus of claim 18, wherein all movements and load forces on the exercise bar are monitored, and the exercise apparatus is immediately shut down when a deviation from the normal rhythmic movement is sensed, and at least one of an audible and a visual alert is actuated when a deviation is sensed, to avoid any possible injury to the user.

20. The exercise apparatus of claim 18, wherein a first leg apparatus is operatively connected to the first arm of the pivot bar, and a second leg apparatus is operatively connected to the second arm of the pivot bar, and the first and second leg apparatuses are adapted for use with the exercise apparatus for leg training and upper limb conditioning.

* * * * *